US008732913B2

(12) United States Patent
Nakajima

(10) Patent No.: US 8,732,913 B2
(45) Date of Patent: May 27, 2014

(54) FASTENER AND BAG HAVING FASTENER

(75) Inventor: Masayoshi Nakajima, Kanagawa (JP)

(73) Assignee: C.I. Kasei Company, Limited, Tokyo (JP)

( * ) Notice: Subject to any disclaimer, the term of this patent is extended or adjusted under 35 U.S.C. 154(b) by 645 days.

(21) Appl. No.: 12/282,622

(22) PCT Filed: Dec. 29, 2006

(86) PCT No.: PCT/JP2006/326296
§ 371 (c)(1),
(2), (4) Date: Sep. 11, 2008

(87) PCT Pub. No.: WO2007/105349
PCT Pub. Date: Sep. 20, 2007

(65) Prior Publication Data

US 2009/0094796 A1 Apr. 16, 2009

(30) Foreign Application Priority Data

Mar. 13, 2006 (JP) ..... 2006-067971

(51) Int. Cl.
*B65D 33/16* (2006.01)

(52) U.S. Cl.
USPC ..... 24/30.5 R; 24/399; 24/585.12; 24/400; 383/63

(58) Field of Classification Search
USPC ..... 383/63–65; 24/400–402, 30.5 R, 399, 24/585.12, DIG. 38
See application file for complete search history.

(56) References Cited

U.S. PATENT DOCUMENTS

| | | | | |
|---|---|---|---|---|
| 4,578,813 | A | 3/1986 | Ausnit | |
| 4,841,603 | A * | 6/1989 | Ragni | 24/584.1 |
| 5,689,866 | A * | 11/1997 | Kasai et al. | 24/585.12 |
| 6,481,890 | B1 * | 11/2002 | VandenHeuvel | 383/64 |
| 7,914,208 | B2 * | 3/2011 | Sprehe | 383/63 |
| 2004/0078938 | A1 * | 4/2004 | Pawloski | 24/400 |
| 2004/0252915 | A1 * | 12/2004 | Nelson | 383/63 |
| 2005/0084183 | A1 | 4/2005 | Ausnit | |
| 2005/0251973 | A1 * | 11/2005 | Sprehe | 24/399 |

FOREIGN PATENT DOCUMENTS

| | | |
|---|---|---|
| EP | 0 647 415 | 4/1995 |
| EP | 1 375 369 | 1/2004 |
| JP | 55-117949 | 8/1980 |
| JP | 10-327912 | 12/1998 |

OTHER PUBLICATIONS

European Office Action issued on Aug. 30, 2010 corresponding to European Patent Appln. No. 06843674.0.

(Continued)

*Primary Examiner* — Robert J Sandy
*Assistant Examiner* — Matthew Sullivan
(74) *Attorney, Agent, or Firm* — K&L Gates LLP

(57) ABSTRACT

A fastener including a pair of base members formed in the shape of a band and a claw unit formed between the pair of the base members, and the claw unit engages the base members with each other and seals a gap between the base members. The claw unit includes a sealing unit and an engaging unit. The sealing unit includes a male claw and a female claw that receives the male claw so as to make an area between the claws liquid-tight or air-tight. The engaging unit includes a pair of hooks. A side wall of the female claw of the sealing unit is formed as a restricting part that prevents a displacement of one hook of the engaging unit in a separation direction.

3 Claims, 4 Drawing Sheets

(56) References Cited

OTHER PUBLICATIONS

European Search Report dated Apr. 19, 2010, for corresponding Patent Application No. 06843674.0.

Korean Office Action issued Jun. 28, 2010, for corresponding Korean Patent Application No. 10-2008-70248354.

Korean Office Action issued Jun. 28, 2010, for corresponding Korean Patent Application No. 10-2008-7024834.

* cited by examiner

FASTENER AND BAG HAVING FASTENER

Priority is claimed on Japanese Patent Application No. 2006-067971, filed Mar. 13, 2006, the content of which is incorporated herein by reference.

BACKGROUND OF THE INVENTION

1. Field of the Invention

The present invention relates to a fastener and a bag having the fastener.

2. Description of the Related Art

In recent years, a bag having a fastener (zipper bag) has been used in the fields of food, medical supplies, industrial goods, and the like. The bag having the fastener includes a pair of band-shaped fasteners, which is composed of a male claw and a female claw and provided at an opening portion of a bag, so as to be freely opened and closed.

As the bag having the fastener, for example, there is a bag where a claw unit is formed between a pair of base members formed in the shape of a band, the base members are fixed to a base film used to form a bag body by thermal bonding or an adhesive, and the claw unit is opened or closed, thereby opening or closing the bag.

Meanwhile, liquid- or air-tightness is required for the bag having the fastener as one of the functions of the bag in terms of the protection of the contents. Compression bags for clothing or futons, or packaging bags with deoxidant have come into use. In recent years, bags having the fasteners, which use more expensive packaging materials having barrier properties, have come into use. The needs for bags to have fasteners, which consider liquid- or air-tightness, has significantly increased.

A fastener, which includes hook-like fitting parts engaging with each other, has been proposed in consideration of the liquid- or air-tightness. However, a general packaging bag was superior in terms of reopening/reclosing, but did not sufficiently function in terms of liquid- or air-tightness.

Accordingly, there has been proposed a fastener where a claw for providing liquid- or air-tightness and a claw having high fittability, that is, two claws are separately and independently formed to ensure high liquid- or air-tightness (for example, Patent Document 1)

[Patent Document 1] Japanese Utility Model Application No. Sho 55-117949

However, in the above-mentioned related art, two claws are separately used as the claw for providing liquid- or air-tightness and the claw having high fittability. Accordingly, it is necessary that sufficient engaging strength should be ensured in order to independently ensure the liquid- or air-tightness and high fittability. For this reason, there is a problem in that the fitted parts should be formed to have a large size and manufacturing cost is thus increased.

Further, there is a problem in that two claws need to be separately and independently opened or closed when being handled and operations are thus troublesome.

Furthermore, the fastener should have a large width in order to separately form the claw for providing liquid- or air-tightness and the claw having high fittability as described above. Accordingly, there is a problem in that a bag is subject to the limitation, such as the deterioration of the shape of a bag or the reduction of a bag manufacturing speed when a bag is manufactured.

SUMMARY OF THE INVENTION

An object of the present invention is to provide a fastener and a bag having the fastener that can ensure sufficient fitting strength and liquid- or air-tightness at a low cost.

Further, another object of the present invention is to provide a fastener and a bag having the fastener that can be easily handled and thus improve operability.

Furthermore, still another object of the present invention is to provide a fastener and a bag having the fastener that can be manufactured without reducing a bag manufacturing speed when a bag having the fastener is manufactured.

In order to achieve the above-mentioned objects, a first aspect of the present invention provides a fastener including a pair of base members formed in the shape of a band; and a claw unit formed between the pair of the base members, the claw unit engaging the base members with each other and sealing a gap between the base members, wherein the claw unit includes a sealing unit and an engaging unit; the sealing unit includes a male claw and a female claw that receives the male claw so as to make a gap between the claws liquid-tight or air-tight; the engaging unit includes a pair of hooks; and a side wall of the female claw of the sealing unit is formed as a restricting part that prevents a displacement of one hook of the engaging unit in a separation direction.

A second aspect of the present invention provides the fastener according to the first aspect of the present invention, further including: a recessed groove formed on a surface of each of the base members facing the engaging unit in a longitudinal direction of the base member.

A third aspect of the present invention provides a bag with the fastener of the first aspect or the second aspect of the present invention, wherein the fastener is provided at an edge of an opening of the bag.

According to the present invention, liquid- or air-tightness is ensured by the sealing unit, and the side wall of the female claw prevents the displacement of one hook of the engaging unit in the separation direction. Accordingly, it is possible to improve the fitting strength of the engaging unit. Therefore, for example, even when the internal pressure of the bag is increased, the engaging unit is not opened and liquid- or air-tightness can be ensured.

Further, since the side wall of the sealing unit is formed as the restricting part for the engaging unit, it is possible to integrate the sealing unit with the engaging unit. Therefore, it is possible to reduce the size of the fastener and the manufacturing cost.

Furthermore, since the size of the fastener can be reduced, it is possible to open or close the fastener by a single operation and to improve operability.

In addition, since the size of the fastener can be reduced, it is possible to manufacture the bag having the fastener without reducing a bag manufacturing speed when the bag having the fastener is manufactured.

Further, according to the present invention, since recessed grooves are formed on the surfaces of the base members at the engaging unit, the base members can be flexible with respect to the recessed grooves. Accordingly, the internal pressure of the bag reduces a force applied in a direction where the engaging unit is opened. As a result, it is possible to further increase the fitting strength of the engaging unit.

The above and other objects, features, and advantages of the present invention will be apparent from the following description when taken in conjunction with the accompanying drawings which illustrate preferred embodiments of the present invention by way of example.

| Explanation of numerals | |
|---|---|
| 1 | fastener |
| 2 | base member |
| 3 | base member |
| 4 | claw unit |
| 5 | sealing unit |
| 6 | engaging unit |
| 7 | female claw |
| 8 | male claw |
| 9 | side wall |
| 10 | side wall |
| 11 | recess |
| 17 | hook-like claw (hook) |
| 18 | hook-like claw (hook) |
| 21 | hook part |
| 23 | hook part |
| 24 | recessed groove |
| 25 | recessed groove |
| 29 | opening |
| 30 | bag having a fastener |
| 31 | bag body |
| 37 | restricting part |

DETAILED DESCRIPTION OF THE INVENTION

A fastener according to the present invention will be described below with reference to FIGS. 1 and 2.

Figure 1:
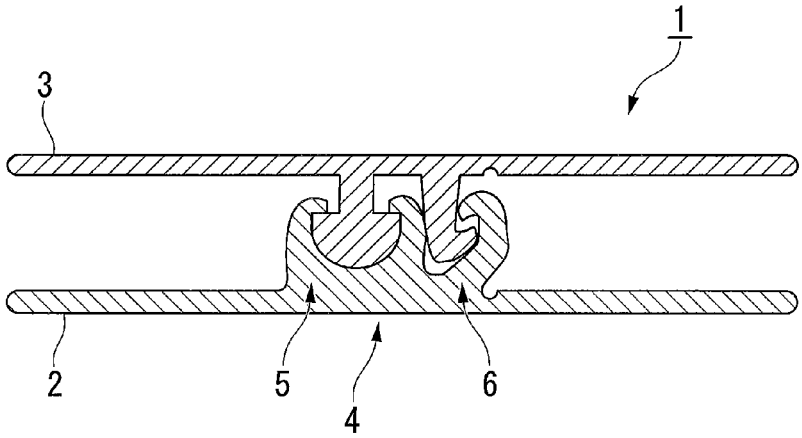
FIG. 1 is a cross-sectional view of a fastener according to an embodiment of the present invention.
Figure 2:
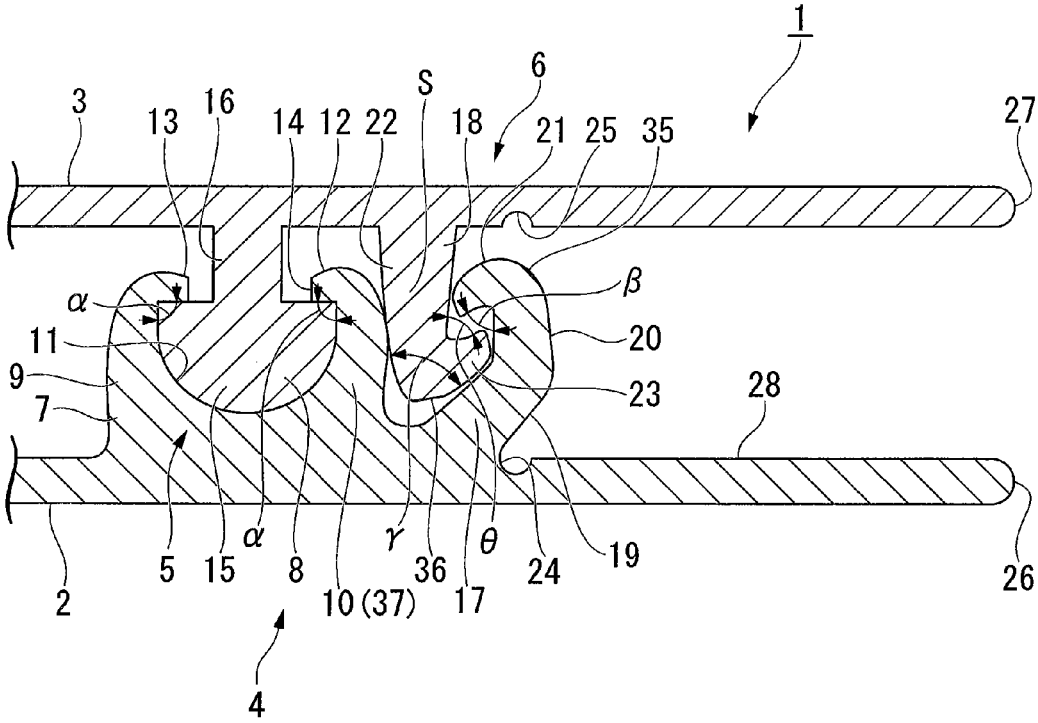
FIG. 2 is a cross-sectional view of a claw unit of the embodiment of the present invention.

As shown in FIGS. 1 and 2, in a fastener 1, a claw unit 4 is formed between a pairs of base members 2 and 3 that are formed in the shape of a band. The claw unit 4 engages both base members 2 and 3 with each other, and seals a gap between the base members 2 and 3.

The claw unit 4 includes a sealing unit 5 and an engaging unit 6.

Examples of the material of the fastener 1 include a polyolefin resin such as low-density polyethylene, straight chain low-density polyethylene, polypropylene, an ethylene-vinyl acetate copolymer, an ethylene-α-olefin copolymer, a propylene-α-olefin copolymer, an ethylene-acrylic acid copolymer, ionomer, or other polyolefin copolymers. Further, examples of the material of the fastener may include the mixture of two or more of them.

In general, it is preferable that melt flow rates of these crystalline polyolefin resins be in the range of 0.5 to 20 g/ten minutes. The reason for this is that extrusion moldability deteriorates when a melt flow rate is less than 0.5 g/ten minutes and stable shape moldability of the fastener 1 deteriorates when a melt flow rate exceeds 20 g/ten minutes. Meanwhile, examples of the material of the fastener 1 may include known additives, such as a stabilizer, an antioxidant, a lubricant, an antistatic agent, and a coloring agent, if necessary, without departing from the scope of the present invention. Further, the resin molded structure of the base members 2 and 3 may be a single-layer structure or a multilayer structure including one or more other resin layers.

The sealing unit 5 includes a female claw 7 of the base member 2 and a male claw 8 of the base member 3 that engage with each other.

The female claw 7 includes a pair of side walls 9 and 10, and the side walls 9 and 10 are formed to stand up on the base member 2. A recess 11 is formed between the side walls 9 and 10 so as to have a semicircular cross-sectional shape.

Furthermore, tongue pieces 12 and 13 are formed to protrude from the ends of the side walls 9 and 10 toward the recess 11. An angle α between each of the tongue pieces 12 and 13 and each of the surfaces of the side walls 9 and 10 facing the recess 11 is substantially a right angle. An opening 14 formed between the tongue pieces 12 and 13 forms a receiving port that receives the male claw 8.

The male claw 8 includes a head 15 that is formed to have a semicircular cross-sectional shape, and is formed so as to correspond to an internal space that is formed by the recess 11 of the female claw 7 and the tongue pieces 12 and 13 and has a semicircular cross-sectional shape. Both ends of the head 15 in a width direction are locked and engage with the tongue pieces 12 and 13.

The head 15 and the base member 3 are connected by a support portion 16. The thickness of the support portion 16 in the width direction is smaller than a distance of the opening 14 of the female claw 7 in the width direction, so that a gap is formed between the support portion 16 and the opening 14.

In the engaging unit 6, a hook-like claw 17 is formed on the base member 2 and a hook-like claw 18 corresponding to the hook-like claw 17 is formed on the base member 3 so that the hook-like claws engage with each other.

The hook-like claw 17 includes an inclined wall 19 and a vertical wall 20 that are integrally formed with each other. The inclined wall stands up so as to be inclined in the vicinity of the side wall 10 of the sealing unit 5 that is formed on the base member 2. The vertical wall 20 extends from the inclined wall 19 so as to be perpendicular to the base member 2.

A hook part 21 is formed at the end of the vertical wall 20 so as to protrude toward the sealing unit 5. An angle β between the hook part 21 and the vertical wall 20 is an acute angle. Further, the outer surface 35 of the hook part 21 facing the base member 3 is formed in an arc shape so as to be curved toward the sealing unit 5. An insertion part S is provided between the end of the hook part 21 and the side wall 10 of the sealing unit 5. The insertion part S serves as a receiving port that receives the hook-like claw 18.

The hook-like claw 18 stands up from the base member 3 and is formed in a tapered shape. The hook-like claw 18 includes a support portion 22 and a hook part 23 that are integrally formed with each other. The support portion 22 is inserted into the insertion part S, and the hook part 23 is formed at the end of the support portion 22. In this case, the thickness of the insertion part S of the support portion 22 in the width direction corresponds to the insertion part S.

The hook part 23 protrudes toward the side opposite to the sealing unit 5, and is formed so as to come in contact with the side wall 10 of the sealing unit 5 and the vertical wall 20 of the hook-like claw 17. Further, an angle θ between the hook part 23 and the support portion 22 is an acute angle so as to correspond to the above-mentioned angle β. In addition, an angle γ between the support portion 22 and the outer surface 36 of the hook part 23 is also an acute angle.

Further, a recessed groove 24 having a substantially semicircular cross-sectional shape is formed on the base member 2 at a root portion of the hook-like claw 17 of the engaging unit 6 in the longitudinal direction of the base member 2.

A recessed groove 25 having a substantially semicircular cross-sectional shape is formed on the base member 3 at a position, which faces the recessed groove 24, in the longitudinal direction of the base member 3.

Meanwhile, the recessed groove 24 may be formed at any position between the root portion that is formed between the base member 2 and the hook-like claw 17, and the substantially middle point 28 that is positioned between the root portion and the end of the base member 2.

Further, each of the recessed grooves 24 and 25 has been formed to have a semicircular cross-sectional shape, but may be formed to have a U or V shape in cross-section.

Furthermore, the recessed grooves 24 and 25 formed on the base members 2 and 3 are not limited to the pair of recessed grooves 24 and 25, and two pairs of recessed grooves may be formed in the above-mentioned range.

In addition, the recessed grooves 24 and 25 have been formed on the inner surfaces of the base members 2 and 3 so as to face each other, but may be formed on the outer surfaces of the base members 2 and 3 opposite to the claw unit 4.

Therefore, according to the above-mentioned embodiment, the head 15 comes in close contact with the recess 11 and the tongue pieces 12 and 13 of the sealing unit 5 without forming a gap, so that it is possible to make the area between the head 15 of the male claw 8 and the recess 11 of the female claw 7 liquid-tight or air-tight.

Further, when the head 15 is pressed toward the opening 14 of the female claw 7, the head 15 widens the opening 14 of the female claw 7. For this reason, it is possible to easily engage the female claw 7 and the male claw 8 with each other.

Furthermore, since a gap is formed between the support portion 16 of the male claw 8 and the opening 14 of the female claw 7, it is possible to easily separate the male claw 8 from the female claw 7 if the support portion 16 is inclined.

As described above, the sealing unit 5 has liquid- or air-tightness, and allows an opening or closing operation to be easily performed.

In the engaging unit 6, each of the angles β and θ of the hook parts 21 and 23 is an acute angle. Accordingly, when the hook parts 21 and 23 engage with each other, it is difficult to separate one hook part from the other hook part.

In addition, when the hook-like claw 18 is pressed toward the hook-like claw 17, the insertion part S is widened since the outer surface 35 of the hook part 21 is formed in the arc shape. For this reason, the engaging unit 6 can make the hook-like claws 17 and 18 engage with each other. In this case, the hook-like claw 17 is easily inclined due to the inclined wall 19 and the groove 24.

As described above, the engaging unit 6 has high fittability, and can be easily fitted.

Further, since the female claw 7 engages with the male claw 8, the side wall 10 of the female claw 7 of the above-mentioned sealing unit 5 serves as a restricting part 37 that prevents the displacement of the hook-like claw 18 in a separation direction. For this reason, it is possible to further improve the engaging strength of the engaging unit 6.

Furthermore, the side wall 10 of the sealing unit 5 is used as the restricting part 37 of the engaging unit 6, so that it is possible to integrate the unit 5 with the unit 6. Therefore, it is possible to make the fastener 1 compact, and to reduce the manufacturing cost.

Next, a bag having the fastener to which the fastener 1 according to the present invention is applied will be described with reference to FIGS. 3 and 4.

Figure 3:
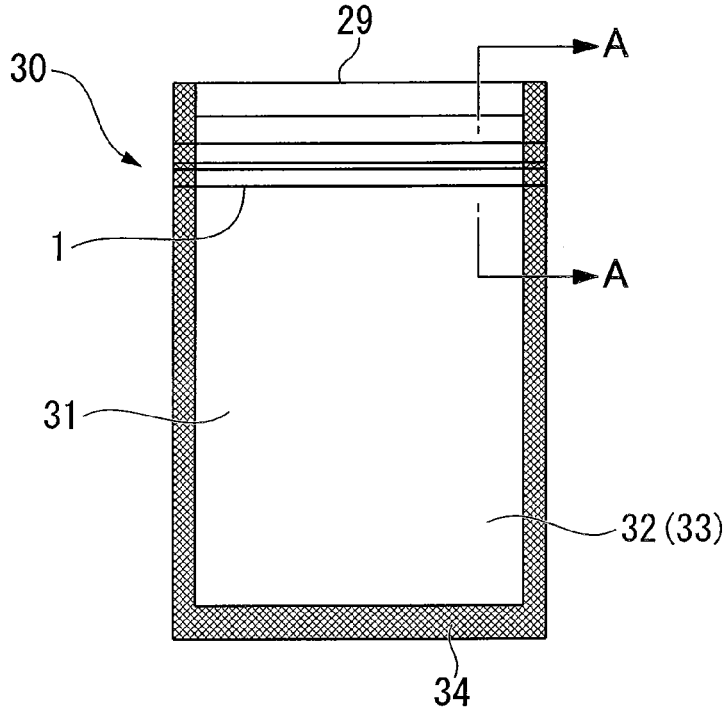
FIG. 3 is a front view of a bag having the fastener according to an embodiment of the present invention.
Figure 4:
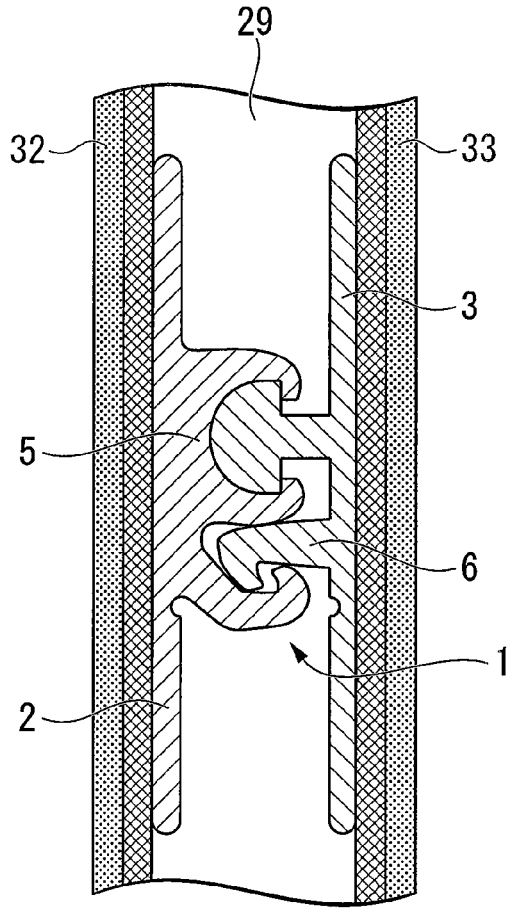
FIG. 4 is a cross-sectional view taken along line A-A of FIG. 3.

As shown in FIGS. 3 and 4, a bag 30 having a fastener includes a bag body 31 that has an opening 29 on one side thereof, and the fastener 1 that is provided in the vicinity of the opening 29 of the bag body 31.

The bag body 31 includes two (front and back) quadrangular base films 32 and 33, and is attached along the sides by thermal bonding except for the opening 29 of the base films 32 and 33. Accordingly, a sealed portion 34 is formed.

Meanwhile, the base films 32 and 33 form a laminated film where an outer film used as an outer layer of the bag body 31 and an inner film used as an inner layer of the bag body 31 are laminated.

The sealing unit 5 of the fastener 1 forms the opening 29 of the bag body 31, and the base members 2 and 3 of the fastener are attached to the base films 32 and 33 by thermal bonding and the like, respectively. Accordingly, the opening 29 of the bag body 31 is sealed.

Therefore, the bag 30 having a fastener can have excellent liquid- or air-tightness and high fitting strength due to the sealing unit 5 and the engaging unit 6 of the fastener 1.

Further, since the sealing unit 5 and the engaging unit 6 are integrated with each other so as to be compact, it is possible to open or close the fastener by a single operation and to easily perform the opening or closing operation of the bag 30 having a fastener.

Furthermore, since the fastener 1 is compact, it is possible to manufacture the bag 30 having a fastener without reducing the bag manufacturing speed when the bag 30 having a fastener is manufactured.

Figure 5:
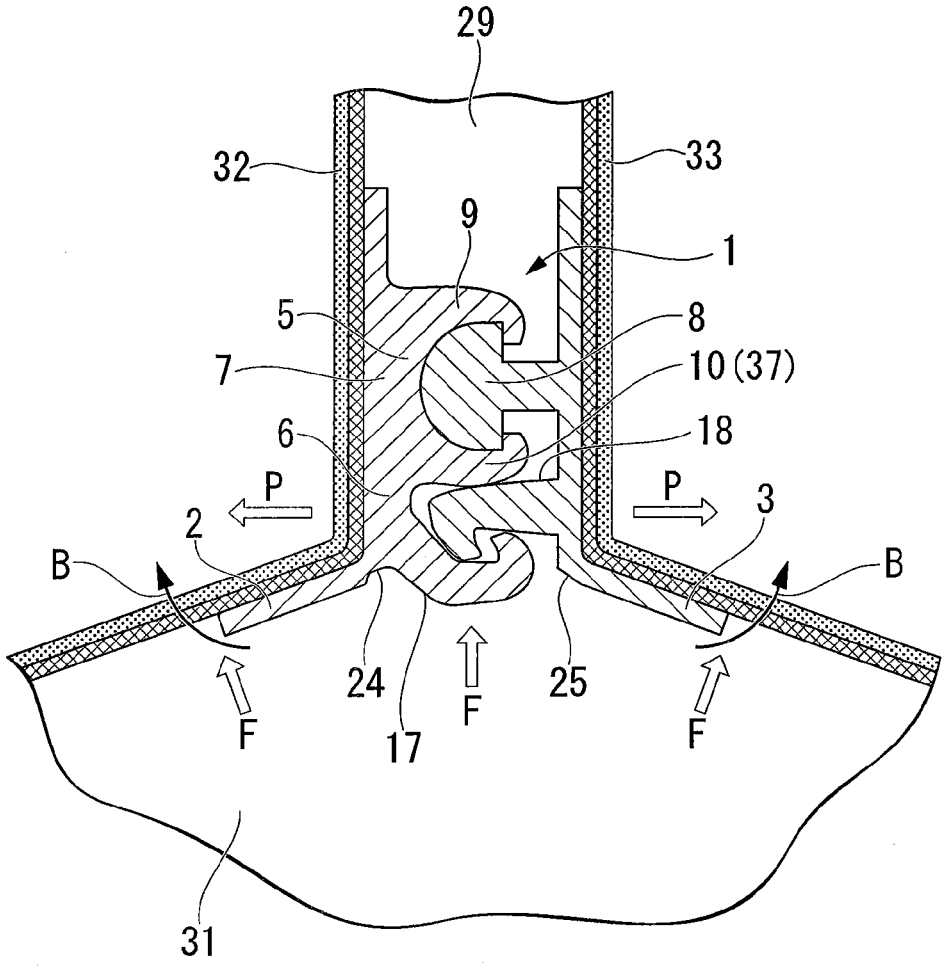
FIG. 5 is a partial cross-sectional view showing the state of the fastener of the bag having the fastener according to the embodiment of the present invention.

In addition, when internal pressure F is applied to the bag body 31 as shown in FIG. 5, a force is applied to the base films 32 and 33 of the bag body 31 in a direction P where the fastener 1 is opened. However, the base members 2 and 3 are inclined with respect to the recessed grooves 24 and 25 in a direction where the fastener 1 is opened (a direction indicated by an arrow B). For this reason, the base members 2 and 3 can reduce a force applied in the direction P where the fastener 1 is opened.

Further, the displacement of the hook-like claw 18 of the engaging unit 6 in the separation direction is prevented by the side wall 10 (37) of the female claw 7 of the sealing unit 5. For this reason, the engaging unit 6 is not opened by the internal pressure F.

Meanwhile, the present invention is not limited to the above-mentioned embodiment. For example, there has been described the case where the hook part 21 of the hook-like claw 17 of the engaging unit 6 is formed to protrude toward the sealing unit 5 and the hook part 23 of the hook-like claw 18 of the engaging unit is formed to protrude toward the side opposite to the sealing unit 5. However, the hook part 23 of the hook-like claw 18 may also include a second hook part that protrudes toward the sealing unit 5, and a hook part may also be formed on the side wall 10 of the sealing unit 5.

Figure 6:
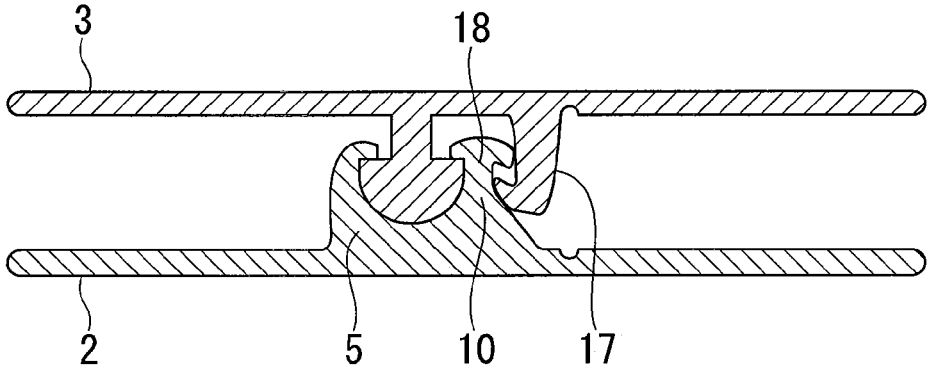
FIG. 6 is a cross-sectional view of a fastener according to another embodiment of the present invention.

Further, as shown in FIG. 6, the hook-like claw 17 and the hook-like claw 18 may be formed in a reverse direction, and the hook-like claw 18 may be formed on the side wall 10 of the sealing unit 5.

Furthermore, in the above-mentioned embodiment, there has been described the case where, for example, the recess 11 having the substantially semicircular cross-sectional shape is formed in the female claw 7 of the sealing unit 5 and the head 15 corresponding to the recess is formed at the male claw 8. However, as long as liquid- or air-tightness can be ensured, the shape of the recess 11 or the head 15 is not limited to the substantially semicircular cross-sectional shape.

In addition, in the above-mentioned embodiment, there has been described the case where, for example, the hook-like claw 17 of the engaging unit 6 is formed by integrating the inclined wall 19, the vertical wall 20 and the hook part 21, and the hook-like claw 18 is formed by integrating the support portion 22 and the hook part 23 so as to correspond to the hook-like claw 17. However, as long as the hook part 21 of the hook-like claw 17 and the hook part 23 of the hook-like claw 18 reliably engage with each other, the shapes of the hook-like claws are not limited thereto.

EXAMPLES

Next, an Example and Comparative Examples of the present invention will be described below and compared with one another. Meanwhile, the example of the present invention is not limited to the following.

Example 1

As the material of the fastener 1 according to the present invention, a resin composition was prepared including 60% by weight of an ethylene-α-olefin copolymer resin that has a density of 916 kg/m$^3$ and a melt flow rate of 8.5 g/ten minutes and 40% by weight of a low-density polyethylene resin that has a density of 921 kg/m$^3$ and a melt flow rate of 5.0 g/ten minutes.

The resin composition was melt and kneaded at 160° C. by an extruder that had a bore diameter of 40 mm and an L/D of 25, introduced into a profile extrusion die that included a claw unit 4 having the shape shown in FIG. 1, extruded, introduced into a cooling water pool, solidified by cooling, and then coiled by a coiler. As a result, a fastener 1 was obtained.

Comparative Example 1

Figure 7:
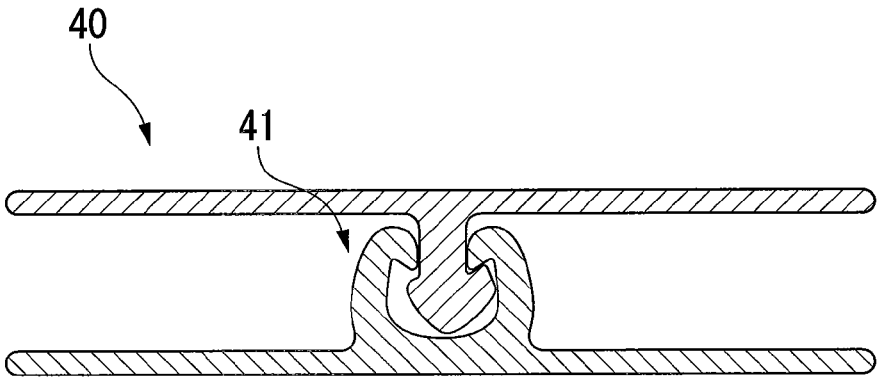
FIG. 7 is a cross-sectional view of a Comparative Example 1 described in Examples of the present invention.

As shown in FIG. 7, a fastener 40 was obtained having the same shape as Example 1 except for the shape obtained from a profile extrusion die that included a claw unit 41 including a male claw and a female claw.

Comparative Example 2

Figure 8:
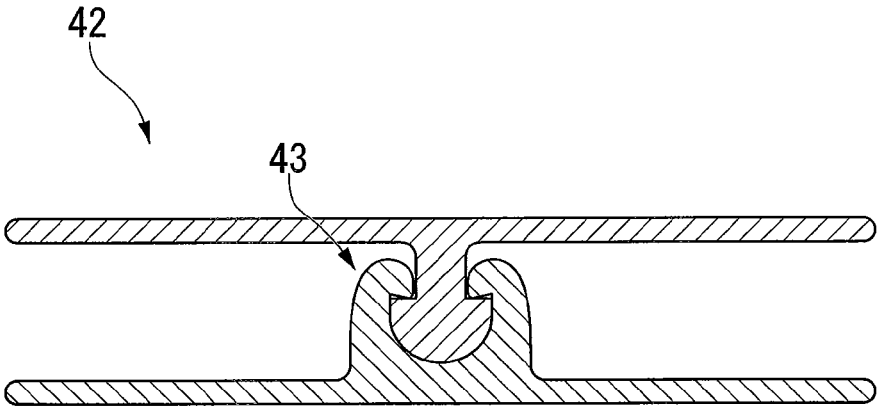
FIG. 8 is a cross-sectional view of a Comparative Example 2 described in Examples of the present invention.

As shown in FIG. 8, a fastener 42 was obtained having the same shape as Example 1 except for the shape obtained from a profile extrusion die that included a claw unit 43 including a male claw and a female claw.

The fastener 1 of Example 1, the fastener 40 of Comparative Example 1, and the fastener 42 of Comparative Example 2 were evaluated as follows:

A bag was formed at a shot number of 40 pieces/minute using two laminated films of nylon (NY)/linear low density polyethylene (LLDPE) (15 μm/40 μm) by a machine for making a three-side-seal type bag having a zipper so that the fasteners 1, 40 and 42 were bonded to an LLDPE film layer. As a result, a bag having the fastener was obtained.

A commercial sealing check solution "Ageless Seal Check Spray" was sprayed on the side of the contents of the bag having the fastener, and kept. Then, after one hour, the permeation and leakage of the sealing check solution from the fastener 1, 40, and 42 were evaluated on the basis of the following criteria.

Evaluation Criteria

There was no leakage to the opening beyond the claw unit: ○

There was leakage to the opening beyond the claw unit: ×

Further, a specimen, which included a laminated film and had a width of 50 mm, was cut out from a bag having the fastener. Then, the fitting strength of the fastener per a width of 50 mm was measured at a test speed of 50 mm/min by a "tensile strength tester (STROGRAPH)" that is manufactured by Toyo Seiki Seisaku-sho, Ltd., and the adequacy thereof was investigated.

Evaluation Criteria

The fitting strength was 40 N or more: adequate

The fitting strength was less than 40 N: inadequate

The evaluation results of the fastener 1 of Example 1, the fastener 40 of Comparative Example 1, and the fastener 42 of Comparative Example 2 were shown in Table 1.

TABLE 1

| | Liquid- or air-tightness | Fitting adequacy (measured value) |
|---|---|---|
| Example 1 | ○ | Adequate (58 N) |
| Comparative Example 1 | x | Adequate (44 N) |
| Comparative Example 2 | ○ | Inadequate (21 N) |

Therefore, according to the above-mentioned example, when contents for requiring liquid- or air-tightness are packed in fields of food, medical supplies, industrial goods, and the like, liquid- or air-tightness and sufficient fitting strength are provided and excellent reopening/reclosing functions do not deteriorate. Further, it is possible to provide a fastener and a bag having the fastener that can be manufactured without reducing the bag manufacturing speed when a bag having the fastener is manufactured.

According to the present invention, it is possible to provide a fastener and a bag having the fastener that can ensure sufficient fitting strength and liquid- or air-tightness at a low cost. The fastener and the bag having the fastener can be easily handled, so that operability can be improved. Further, according to the present invention, it is possible to provide a fastener and a bag having the fastener that can be manufactured without reducing a bag manufacturing speed when a bag having the fastener is manufactured.

What is claimed is:

1. A fastener comprising:

a pair of base members formed in the shape of a band;

a claw unit formed between the pair of said base members, said claw unit engaging said base members with each other and sealing a gap between said base members; and two recessed grooves formed on a same lateral side of an said-engaging unit in a longitudinal direction of said base member, wherein said claw unit comprises a sealing unit and said an-engaging unit;

said sealing unit comprises a male claw and a female claw that receives said male claw so as to make an area between said claws liquid-tight or air-tight;

said male claw comprises a head;

said female claw comprises a pair of side walls;

said engaging unit comprises a pair of hooks;

one hook of said engaging unit is formed on one of said base members;

another hook of said engaging unit is formed on another of said base members;

a side wall of said female claw of said sealing unit is formed as a restricting part that prevents a displacement of one of said hooks of said engaging unit in a separation direction; and said engaging unit is provided between said sealing unit and said recessed grooves.

2. A bag with the fastener of claim 1, wherein said fastener is provided at an edge of an opening of a bag.

3. A bag with the fastener of claim 1, wherein said sealing unit is provided between said opening of said bag and said engaging unit; and said grooves are provided only on the lateral side that is towards an inside of said bag.

* * * * *

UNITED STATES PATENT AND TRADEMARK OFFICE

CERTIFICATE OF CORRECTION

PATENT NO. : 8,732,913 B2
APPLICATION NO. : 12/282622
DATED : May 27, 2014
INVENTOR(S) : Nakajima It is certified that error appears in the above-identified patent and that said Letters Patent is hereby corrected as shown below:

ON THE TITLE PAGE ITEM [75]:

replace

"Masayoshi Nakajima, Kanagawa (JP)" with
-- Masayoshi Nakajima, Hiratsuka-shi (JP) --.

Signed and Sealed this
Twenty-third Day of September, 2014

Michelle K. Lee

Michelle K. Lee
*Deputy Director of the United States Patent and Trademark Office*